United States Patent [19]

Wache

[11] Patent Number: 4,895,212

[45] Date of Patent: Jan. 23, 1990

[54] ROTARY HAMMER

[75] Inventor: Robert Wache, Wiesbaden, Fed. Rep. of Germany

[73] Assignee: Black & Decker Inc., Newark, Del.

[21] Appl. No.: 317,180

[22] Filed: Feb. 28, 1989

[30] Foreign Application Priority Data

Mar. 4, 1988 [DE] Fed. Rep. of Germany ..... 3807078

[51] Int. Cl.[4] ..... B25D 11/10

[52] U.S. Cl. ..... 173/48; 173/109; 173/116; 173/123; 192/53 C

[58] Field of Search ..... 173/13, 14, 47, 48, 173/109, 123, 116; 192/53 C, 53 B, 53 R, 53 A

[56] References Cited

U.S. PATENT DOCUMENTS

| | | | |
|---|---|---|---|
| 2,736,411 | 2/1956 | Schmid | 192/53 C |
| 2,976,974 | 3/1961 | Blyth . | |
| 3,374,870 | 3/1968 | Johnston . | |
| 3,430,709 | 3/1968 | Miller | 173/123 |
| 3,633,716 | 1/1972 | Gortz | 192/53 C |
| 4,280,359 | 7/1981 | Schmid et al. | 73/123 |
| 4,719,976 | 1/1988 | Bleicher et al. | 173/123 X |
| 4,750,567 | 6/1988 | Grossman et al. | 173/48 X |

FOREIGN PATENT DOCUMENTS

| | | | |
|---|---|---|---|
| 3136264 | 3/1983 | Fed. Rep. of Germany . | |
| 576451 | 10/1977 | U.S.S.R. | 192/53 C |

*Primary Examiner*—Frank T. Yost
*Assistant Examiner*—Rinaldi Rada
*Attorney, Agent, or Firm*—Dennis A. Dearing; Charles E. Yocum; Edward D. C. Bartlett

[57] ABSTRACT

A rotary hammer has a pneumatic hammer mechanism which can be driven by means of a driver-part mounted rotatably on an intermediate shaft, with which driver-part a first coupling element of a coupling is non-rotatably connected, while the second coupling element of the coupling is non-rotatably mounted on the intermediate shaft and through axial displacement can be brought into positive coupling engagement with the first coupling element. A synchronizing arrangement is provided, which on approach of the coupling elements to one another, accelerates the first coupling element at least approximately to the rotational speed of the second coupling element and only then permits the positive engagement of the coupling elements.

16 Claims, 6 Drawing Sheets

ROTARY HAMMER

BACKGROUND OF THE INVENTION

1. Field of the Invention.

This invention relates to a rotary hammer with a pneumatic hammer mechanism having a reciprocable piston which drives a ram, which piston is driven by means of a driving part arranged rotatably on an intermediate shaft with which a first coupling element of a coupling non-rotatably connected, while a driven second coupling element of the coupling can be slid axially into positive engagement with the first coupling element, a synchronizing arrangement being provided in the coupling and arranged so that as the coupling elements are brought close together, the first coupling element is accelerated approximately to the rotational speed of the second coupling element.

2. Related Prior Art.

A known rotary hammer of this type (DE-Patent No. 31 36 264) has a first coupling element which is driven by the intermediate shaft by means of a gear arrangement and does not rotate when the hammer mechanism is not switched on. On the side of this first coupling element facing the tool-holder, there is a frusto-conical engagement surface, and in addition the first coupling element has coupling holes for the positive connection of coupling pins. The coupling pins are part of the second coupling element, which is in non-rotatable engagement with the rear part of the tool-spindle and rotates with it. A synchronizing disc is non-rotatably connected to the second coupling element, which is slidable axially on the rear part of the tool-spindle and is urged by a spring towards the first coupling element.

If the tool-spindle, following engagement with the work-piece of a tool inserted in the tool-holder, is displaced further into the housing of the rotary hammer then through the force of the spring acting on the synchronizing disc an outer frusto-conical surface provided on the synchronizing disc will be brought into engagement with the frusto-conical engagement surface of the first coupling element and accelerates this. Further inward displacement of the tool-spindle into the housing of the rotary hammer brings the front ends of the spring-loaded coupling pins near to the coupling holes of the first coupling element and finally into positive engagement with these coupling holes.

In this known rotary hammer it is possible, by the exertion of very strong pressure on the tool-spindle, for a very fast engagement of the coupling to take place, the result being that the first coupling element will not yet have been accelerated to approximately the rotational speed of the second coupling element when the front ends of the coupling pins begin to run over the coupling holes. This causes considerable noise and vibration, and when the pins suddenly enter the holes considerable vibration of the whole rotary hammer results.

Furthermore, it appears that the operation of the previously known coupling is questionable, because it cannot be understood how to prevent contact of the front ends of the coupling pins with the region of the first coupling element having the coupling holes immediately before or on light engagement of the respective frusto-conical surfaces of the first and second coupling elements. In view of this, proper synchronization cannot take place before the parts of the coupling provided for the positive coupling engagement come into engagement.

In another known rotary hammer (U.S. Pat. No. 3 430 709) in which the second coupling element is arranged to be non-rotatable on the intermediate shaft, the first and second coupling elements have teeth or dogs facing each other for positive coupling engagement, and the second coupling element is acted on by a spring operating in the direction of coupling engagement. The coupling elements can be held out of engagement by a linkage which can be operated externally so that when the linkage is released, the second coupling element is displaced axially under the action of the spring and comes into positive engagement with the first coupling element.

In this known rotary hammer, the engagement of the coupling elements can in practice only be achieved when stationary, i.e. the coupling must be brought into the desired position for the required operational mode before activation of the motor of the rotary hammer; that is, either in the position for simple drilling in which the two coupling elements remain out of engagement, or in the position for hammer-drilling action, in which the two coupling elements are in positive engagement. Switching-over between drilling and hammer-drilling with the intermediate shaft rotating leads to an impingement of the rotating teeth or dogs of the second coupling element non-rotatably mounted on the intermediate shaft with the stationary teeth or dogs of the non-rotating first coupling element connected with the driving part for the hammer action, and thus not only to a high noise production but also to considerable loading of the teeth or dogs and a sudden start-up of the hammer action, as a result of which heavy loadings occur inside the rotary hammer. Furthermore, it is quite uncertain when the positive engagement of first and second coupling elements actually takes place.

There is also already known (U.S. Pat. No. 4 280 359) a rotary hammer with a pneumatic hammer-mechanism in which, in order to switch to the hammer-drilling action, the spindle of the rotary hammer is displaced by the pressure of the hammer bit on the work-piece, and thus the second coupling element is brought into coupling engagement with the first coupling element. With this type of activation of the hammer action, in order to avoid difficulties because of the different rotational speeds of the rotating second coupling element mounted on the driven intermediate shaft and the non-rotating first coupling element connected with the initially non-rotating driving part for the hammer-mechanism, the two coupling elements have frusto-conical coupling surfaces of complementary shapes and which gradually come into engagement on axial displacement of the second coupling element so that the first coupling element is accelerated by the gradually increasing friction between the coupling surfaces and is gradually brought to the rotational speed of the second coupling element.

In this known construction, a force-determined or frictional coupling is used, i.e. a coupling which connects only through frictional engagement of the coupling surfaces. In use, therefore, the user must always exert such a pressure on the rotary hammer that the two coupling elements are kept in coupling engagement. Applying such a force makes the use of the rotary hammer more difficult, particularly because pulsating forces act on the coupling owing to the reciprocating movement of the piston of the hammer mechanism.

SUMMARY OF THE INVENTION.

It is an object of the invention to provide a rotary hammer which can be switched into hammer drilling mode during the drilling action, without the user having to use considerable force to hold the hammer mechanism coupling continuously in engagement and without the danger of the parts provided to form a positive coupling engagement running over each other, producing noise and vibration.

To solve this problem a rotary hammer of the previously mentioned type is so constructed in accordance with the invention that the synchronization arrangement has a synchronizing element which initially blocks the axial approach of the coupling elements and only permits the positive engagement of the coupling elements if the first coupling element is accelerated at least approximately to the rotational speed of the second coupling element.

In the rotary hammer according to the invention, the positive engagement of the coupling elements of the coupling is thus enabled only if the two coupling elements have approximately the same rotational speed, i.e. if the synchronization arrangement of the initially stationary first coupling element has been brought to the rotational speed of the second coupling element, so that the coupling engagement may take place without disturbing noise and without high stresses on the teeth or dogs of the coupling. In addition, through the gradual acceleration of the first coupling element, the hammer mechanism is also accelerated gradually and not suddenly.

With a rotary hammer of this type it is for example possible for the user initially to drill through a first region of a work-piece, perhaps wood panelling of a wall, and then to switch over into hammer drilling action without interrupting the operation and without withdrawing from the work-piece so that there is a continuous operation on the work-piece in this way, e.g. the boring of a hole in a concrete wall covered by wood panelling.

If one provides in a rotary hammer according to the invention the possibility of producing the engagement of the coupling elements through axial displacement of the tool-spindle against a spring load following pressure on the tool bit in the tool-holder, then by this, although a positive coupling is achieved there results a noise- and vibration-free coupling process and with it a corresponding activation of the hammer-mechanism, without the user always having to exert considerable force for maintaining the coupling engagement, as in the known rotary hammer according to U.S. Pat. No. 4 280 359. On the contrary, it is sufficient for the user to apply such a force that the spring force acting in the direction of separation of the coupling elements is overcome, while the forces transmitted from the hammer mechanism on the coupling can no longer influence the coupling engagement.

The synchronizing arrangement provided with the rotary hammer according to the invention can have a cup-shaped element, fixed non-rotatably on one of the coupling elements and made, for example, from spring steel, which cup-shaped element is open to the other of the coupling elements and has an open region enlarged in relation to the adjacent wall-region. The synchronizing arrangement may then have a follower arrangement fixed to the other of the coupling elements, which follower arrangement can be brought into engagement with the cup-shaped element, and which has the synchronizing element radially extensible through forces acting in the circumferential direction, so as to come into engagement with the enlarged open region of the cup-shaped element when the coupling elements approach.

With the use of such a synchronizing arrangement, when the coupling elements approach each other, the synchronizing element comes into contact with the cup-shaped element in the transition region between the enlarged open region and the adjacent wall-region of the cup-shaped element, so that on rotation of the synchronizing element relative to the cup-shaped element, a force acts in the circumferential direction which expands the synchronizing element and through this prevents the further introduction of the synchronizing element into the cup-shaped element.

Furthermore, the engagement of the synchronizing element with the cup-shaped element causes an acceleration of the non-rotating element, by means of which the rotational speed of cup-shaped element and synchronizing element and thereby the rotational speeds of the two coupling elements are gradually equalized with each other. As a result of this, the force acting in a circumferential direction on the synchronizing element reduces, and with effectively equal rotational speeds of the synchronizing element and the cup-shaped element the synchronising element can be inserted further into the cup-shaped element by the radial compression thereof, whereupon there then results a positive engagement of the two coupling elements without noise and vibration.

In a preferred embodiment, the synchronizing element consists of a circular arc-shaped strap made of elastically deformable material, the ends of which are spaced apart in the circumferential direction and are bent inwards to project into circumferentially-extending reception slots of a holding section connected non-rotatably with the corresponding coupling element. The strap in the unstressed condition in the reception slots is reciprocatingly movable in the circumferential direction within limits, and is supported against pressure in the circumferential direction by one of its bent-in ends received at one end in the slots to permit the previously mentioned expansion to take place.

In order to ensure the positioning and guiding of the strap, this can have at least one guide projection, extending radially inwardly between its bent-in ends, projecting into a circumferentially extending guide slot in the holding section.

The holding section can be part of a bush having coupling projections on its inner side, which is arranged non-rotatably but axially displaceable on the intermediate shaft and forms the second coupling element.

On the outer periphery of the bush an annular groove can be provided, into which a shifting-element extends, which is coupled to the tool spindle and can be moved axially with this, so that, by movement of the tool spindle following engagement of the tool bit with the work-piece, a corresponding displacement of the bush takes place in the direction of coupling engagement.

The shifting-element can be moved in the direction of engaging the coupling against the spring force, so that, in order to maintain the coupling engagement, only this spring force needs to be overcome by the user.

The shifting-element can be non-rotatably supported on a bearing on the tool spindle.

In order also to make possible a simple drilling action with a rotary hammer of this type, the shifting-element can be fixed in its position nearer to the tool-holder, so that axial displacement of the tool spindle is prevented.

BRIEF DESCRIPTION OF THE DRAWINGS.

The invention will be explained in more detail in the following description with reference to drawings, which show an embodiment example.

DETAILED DESCRIPTION OF THE PREFERRED EMBODIMENT

Figure 1:
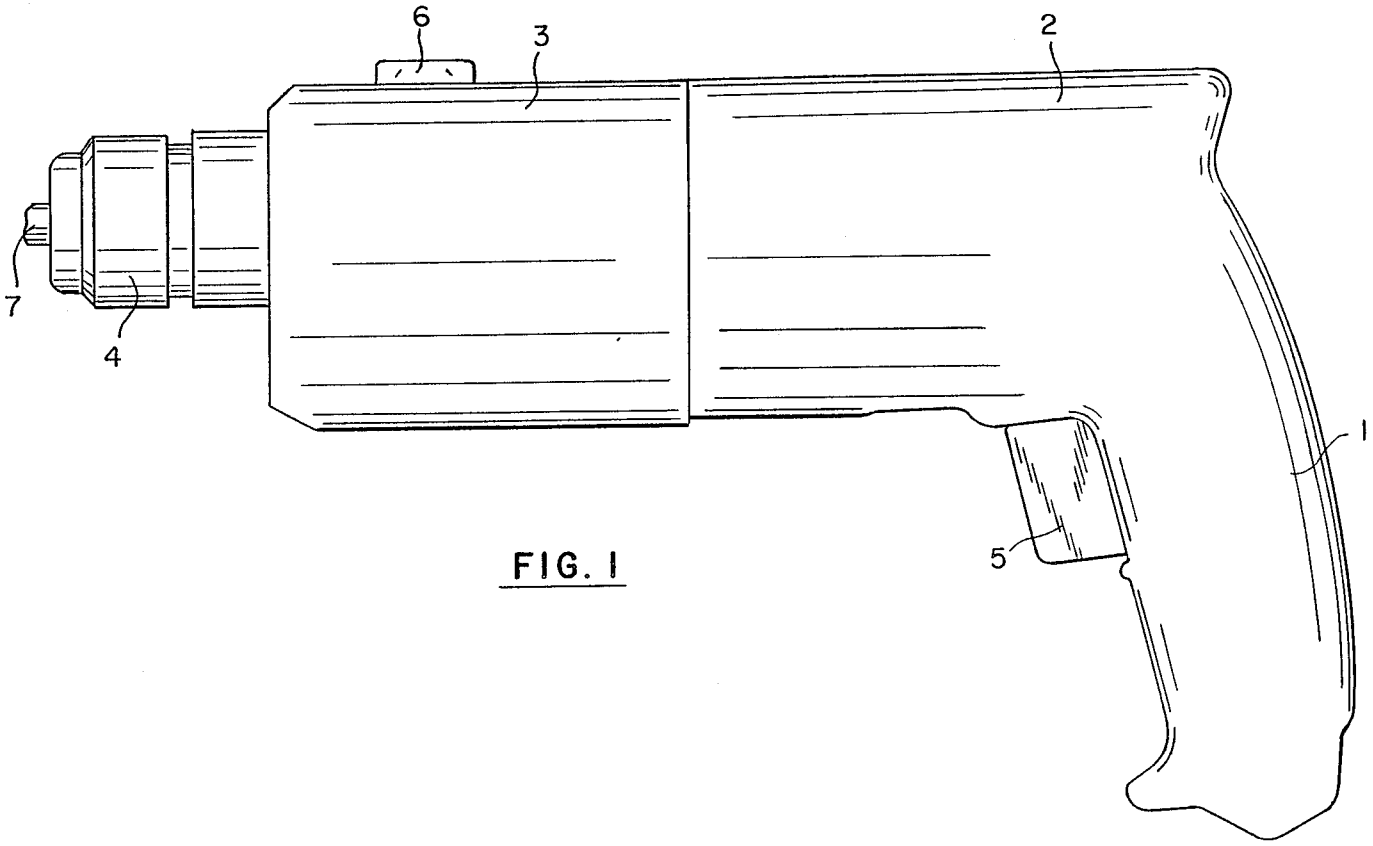
FIG. 1 is a side view of a rotary hammer, with the electric cable omitted.

The rotary hammer shown in FIG. 1 has a motor-housing 2 with a handle 1, in which a trigger 5 for an on/off switch is arranged. Attached to the motor-housing 2 is a gear-housing 3, at the front end of which there is a tool holder 4 with a partially-shown tool bit 7 in the form of a hammer bit. The gear housing has on its upper side a turn-button 6 for switching between a simple drilling mode and a hammer drilling mode.

The housing of the rotary hammer can consist of half-shells, in a known manner, not however shown.

Figure 2:
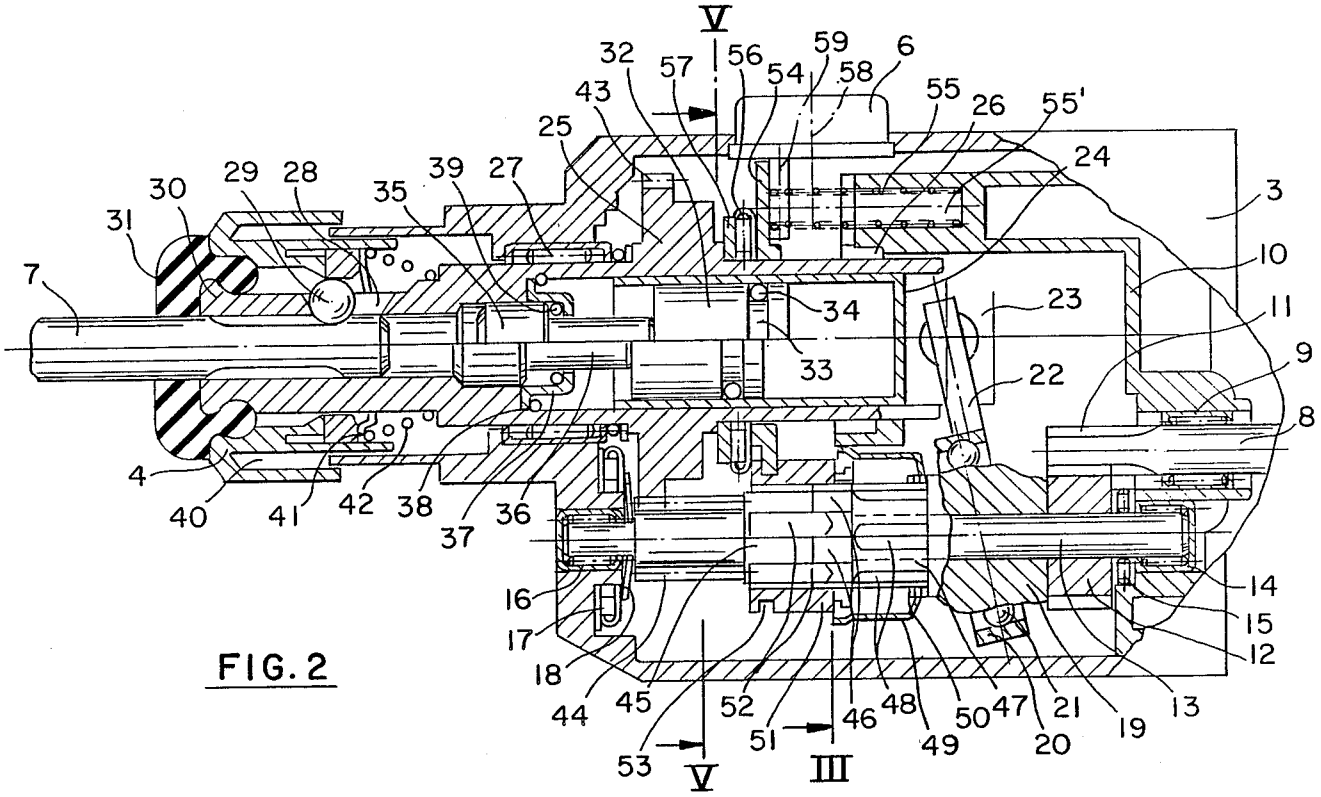
FIG. 2 is a sectional view through the gear-housing and the tool-holder of the rotary hammer, in which the coupling for driving the hammer mechanism is disengaged.

As can be seen from FIG. 2, in the gear-housing 3 there is an intermediate shaft 13 which runs with its right-hand end in FIG. 2 in a needle-bearing 14 held in an inner housing-part 10, against which bears a thrust-bearing 15, while the left-hand end in FIG. 2 of the intermediate shaft 13 is journalled in a needle-bearing 16 held in the housing 3. In order to hold the intermediate shaft 13 and the axially non-displaceable elements on it, still to be described, in a definite position, a dish-spring 18 is fitted in a recess in the region of the left-hand end of the intermediate shaft 13, the outer part of which spring bears on a race of a roller-bearing 17 mounted in the housing 3.

Near to the thrust-bearing 15, a gear 12 is pressed on to the intermediate shaft 13, which meshes with the pinion 11 of the armature shaft 8 of an electric motor (not shown). The end of the armature shaft adjacent the pinion 11 runs in a needle-bearing 9 fixed in the housing part 10. Next to the gear 12 a hub 19 is mounted rotatably on the intermediate shaft 13, the outer circumference of which hub forms an obliquely-disposed inner race for balls 21, around which an outer race 20 is rotatably mounted. An arm 22 is fastened on the outer race and extends obliquely to engage with the rear end 23 of a hollow piston 24. The type of coupling between the arm 22 and hollow piston 24 is described, for example, in the already mentioned U.S. Pat. No. 4 280 359.

A cylindrical ram 32 is slidably arranged in the hollow piston, an O-ring being located in an annular groove 33 in the ram to effect an air-tight seal between the inner wall of the hollow piston 24 and the ram 32. Reciprocating movement of the hollow piston 24 creates an alternating over-pressure and under-pressure in the chamber bound by the inner end (right-hand end in FIG. 2) of the ram 32 and the interior of the hollow piston 24 to the right of the ram. This alternating pressure causes the ram 32 to be reciprocated to produce impacts on the rear end of an intermediate dolly 35, 36, which are transferred by the intermediate dolly to the rear end of the tool or hammer bit 7.

As shown, the hollow piston 24 is mounted axially displaceably in the tool-spindle 25, the hollow piston 24 being held by the arm 22 against rotation about its longitudinal axis. The tool-spindle 25 is rotatably mounted with its rear end portion in a sintered bearing 26 fixed in the housing part 10 and with its central portion in a needle-bearing 27 fixed in the gear-housing 3. Within the tool-spindle 25, there is a retainer 37 held by a circlip 38 located in a groove in the inner wall of the tool spindle 25, the retainer having central opening and being held with its circumferential flange against a shoulder in the tool spindle 25, as shown. The rear section 36 of the intermediate dolly extends through the central opening of the retainer 37, the front section 35 of the dolly having a larger diameter than that of the central opening of the retainer 37, so that the dolly can move backwards only to a position where the shoulder at the transition between the sections 35 and 36 of the intermediate dolly engages a damping ring 39 of an elastic material within the retainer 37. The forward movement of the intermediate dolly is limited by a step within the tool-spindle 25.

The rear end of the hammer bit 7, which has engagement slots formed in a known manner, is inserted from the front into the tool-spindle 25. A driver ball 29 lies in one of these engagement slots, and is located in a through-opening 28 extending inwardly of the tool-spindle 25, and is held in the position shown in FIG. 2 against radially outward displacement in the usual way, but can be moved radially outward to a limited degree for the hammer bit 7 to be inserted or removed by corresponding displacement of the front part 4 of the tool-chuck against the pressure of the spring 42.

Between the front end of the tool-spindle 25 and the front part 4 of the tool holder there is a seal 31 of elastic material, such as of rubber, which is held in position by an annular rib 30 on the tool-spindle 25.

In use, through pressure of the rotary hammer against a work-piece and through the axial force exerted in this way on the intermediate dolly 35, 36, the holding element 37, the circlip 38 and the tool-spindle 25, the tool spindle becomes displaced backwards (in FIG. 2, to the right) against a spring 55 (described below). Through this axial displacement of the tool-spindle 25, the front end of the housing 3 enters the annular groove 40 formed in the front part 4.

The tool-spindle 25 has an external spur-gear 43, which meshes with a spur-gear 44 on the intermediate shaft 13. The spur-gear 44 on the intermediate shaft 13 has a greater axial length than the spur-gear 43 of the tool-spindle 25, as can be seen in FIG. 2.

Next to the spur-gear 44, the intermediate shaft 13 has a section 45 of increased diameter at the right-hand end of which coupling-projections are formed, between which extend guiding grooves. On this section 45 there is a bush 51 which has axially extending coupling teeth on its inner surface, the right-hand ends of which extend between the coupling projections 46, so that the bush 51 is held non-rotatably on the intermediate shaft 13.

The bush 51 forms, as will be further described, a coupling element of a positive coupling. The hub 19, which is mounted to rotate on the intermediate shaft 13, is provided with an increased diameter region adjacent the region 47, which has axially-extending outwardly-projecting coupling teeth 48, between which are formed reception grooves for the coupling teeth 52, while the reception grooves between the coupling teeth 52 are so dimensioned that they can receive the coupling teeth 48.

Figure 4:
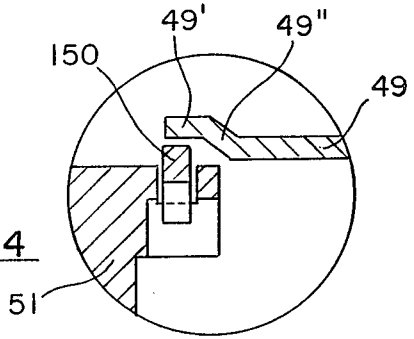
FIG. 4 is an enlarged partial drawing showing the relative positions of the synchronizing element and the cup-like element of the coupling arrangement in the position according to FIG. 2.

On the hub 19, on the right-hand end in FIG. 2 of the section 47 which has the coupling teeth 48, there is mounted a cup-shaped element 49 made, for example, from spring steel, and prevented from rotating by a spring-ring 50. This cup-shaped element is open towards the bush 51, and, as shown in FIG. 4, has an open region 49' with a larger clear diameter, from which the clearance reduces over a cone-shaped region 49''.

In the end of the bush 51 adjacent the open region 49' of the cup-shaped element there is a synchronizing element 150, the shape and form of which will be described later.

Figure 5:
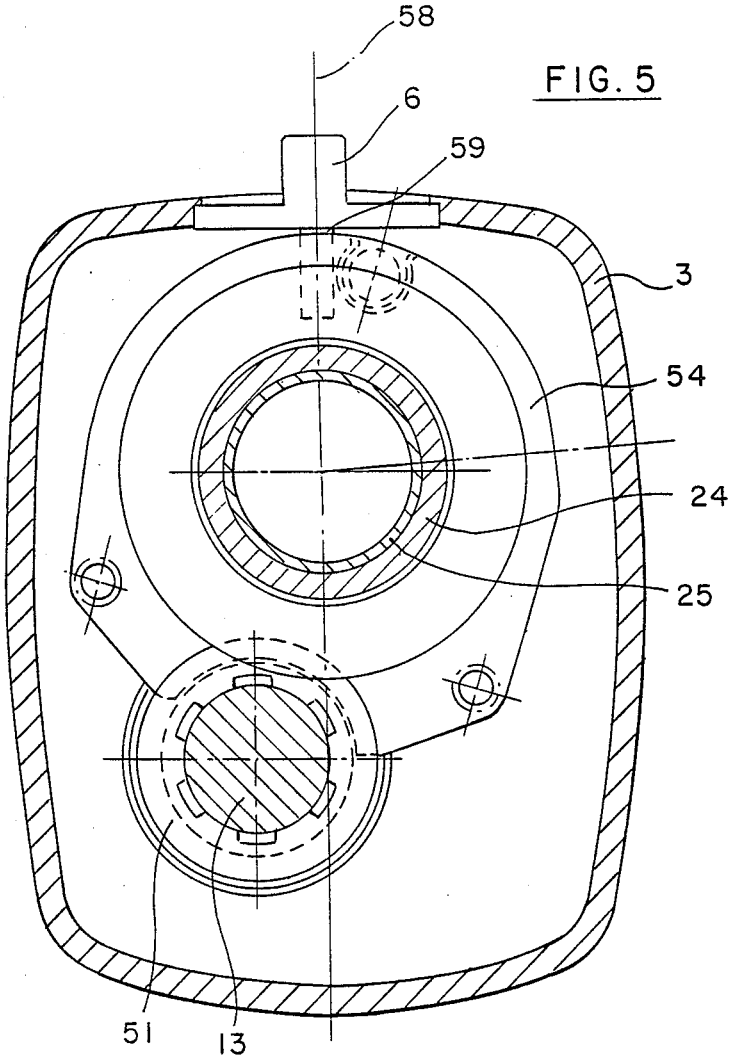
FIG. 5 is a sectional view taken along line V—V in FIG. 2, in which the wall of the gear-housing is omitted in the region of the turn-button.

On the end of the bush 51 opposite to the synchronizing element 150 an annular groove is formed into which a part of a shifting-element 54 (FIG. 2) extends, which has a circular arc-shaped boundary surface, and which is held non-rotatably in the gear-housing 3 to surround the tool-spindle 25. This shifting-element 54 is pressed by three springs, of which only the spring 55 is shown (FIG. 5) located in the bottom of a blind hole 55' in the housing part 10 (FIG. 2), in the direction of the front end of the rotary hammer and against a roller bearing 56 supported by a washer 57 which lies against an annular shoulder of the tool-spindle 25.

In the position shown in FIG. 2, the shifting-element 54 is prevented from displacement to the right against the spring pressure by an eccentric pin 59, which is formed on the under-side of the adjusting knob 6. The adjusting knob 6 is held in the wall of the gear housing 3 and can be rotated about an axis 58.

Through the position of the eccentric pin 59 on the right-hand side (FIG. 2) of the shifting-element 54, this, as already mentioned, is blocked against displacement to the right - that is, from the front end of the rotary hammer - and because of this, the tool-spindle 25 also cannot be pushed backwards by axial pressure exerted by the user on the front end of the hammer bit on the work-piece. In this position, as also shown in FIG. 2, the coupling teeth of the bush 51 remain in engagement with the intermediate spaces between the coupling projections 46 on the intermediate shaft 13, so that the bush 51 rotates with the intermediate shaft 13, although the hub 19 together with the coupling teeth 48 formed on it will not be turned on rotation of the intermediate shaft 13. Thus the hammer mechanism does not rotate, and the rotary hammer operates with a simple drilling action.

It should be noted that in this condition, the cup-shaped element 49 is not in contact with the synchronizing element 150, as can be seen from FIG. 4.

Figure 12:
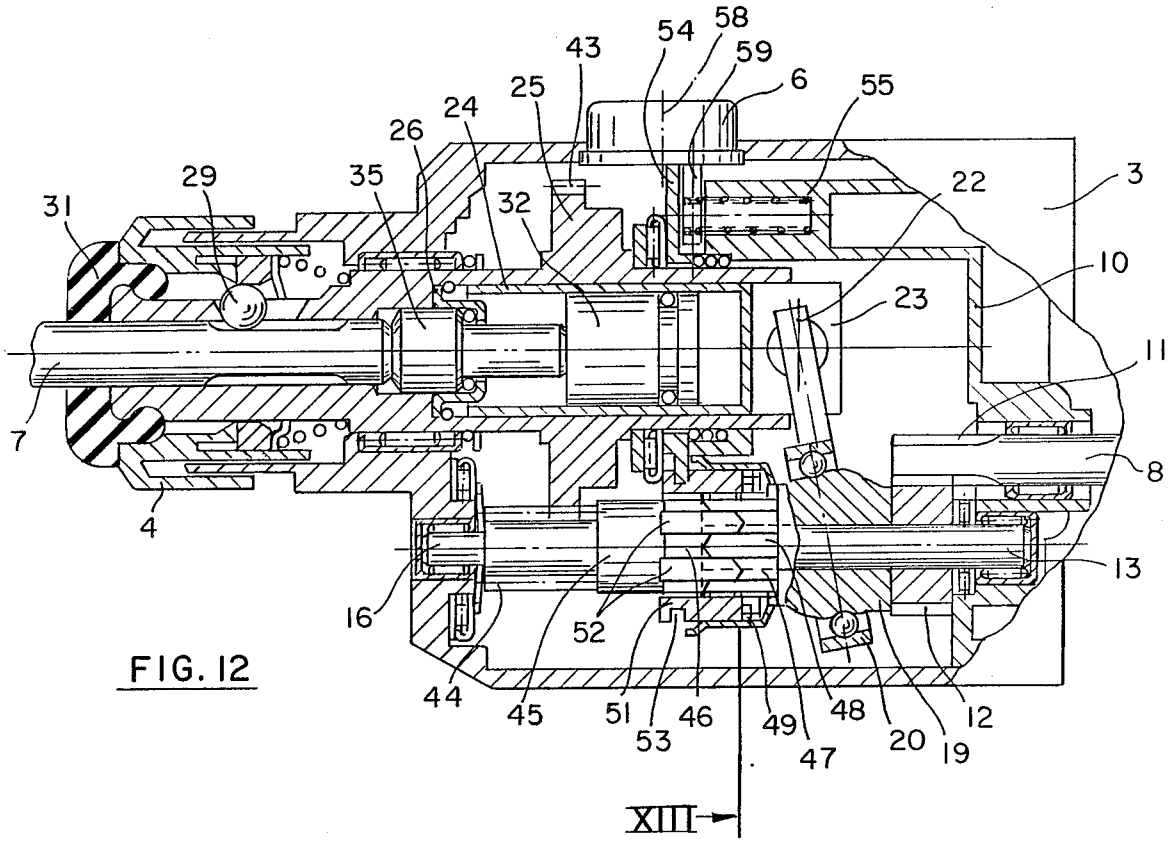
FIG. 12 is a sectional view corresponding to FIG. 2, showing the rotary hammer with full engagement of the coupling for driving the hammer mechanism.

In order to actuate the hammer mechanism, the adjusting knob 6 must be rotated about the axis 58, so that it is moved to the position shown in FIG. 12. In this position the eccentric pin 59 no longer prevents backwards displacement of the tool-spindle 25 and the shifting-element 54, through which the coupling teeth 52 of the bush 51 are brought into the intermediate spaces between the coupling teeth 48 of the section 47 of the hub 19 and correspondingly the coupling teeth 48 are brought into the intermediate spaces between the coupling teeth 52. In this way, the hub 19 is positively coupled with the intermediate shaft 13 and thus the hammer mechanism is driven. During this, the spur-gear 43 is displaced in the axial direction of the spur-gear formed on the intermediate shaft 13, whereby the engagement of these spur-gears is maintained.

The already-mentioned cup element 49 and the synchronizing element 150 are provided in order to effect the coupling engagement without producing noise and other difficulties. The synchronizing element 150, which for example can consist of spring-steel, has the shape of a circular arc-shaped strap with ends 151 and 152 turned inwardly, which extend into the circumferentially extending slots 155 and 156 of the bush 51. In addition, two projections 153 are formed on the strap 150, which lie between the bent-in ends 151 and 152 and project into the guiding slots 157 of the bush 51. The reception slots 155 and 156 as well as the guiding slot 157 are so dimensioned that the synchronizing element 150 can be reciprocatingly moved within limits in the circumferential direction.

Figure 7:
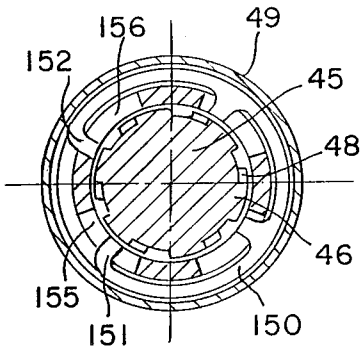
FIG. 7 is a sectional view along the line VII—VII in FIG. 6.
Figure 6:
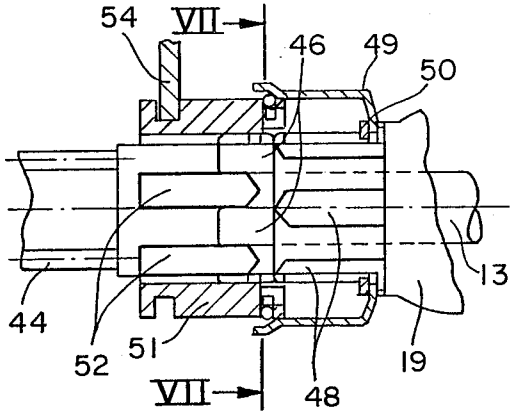
FIG. 6 is a sectional view corresponding to FIG. 3, but with the second coupling element displaced and with the synchronizing element in a position in which it blocks the engagement of the coupling.
Figure 8:
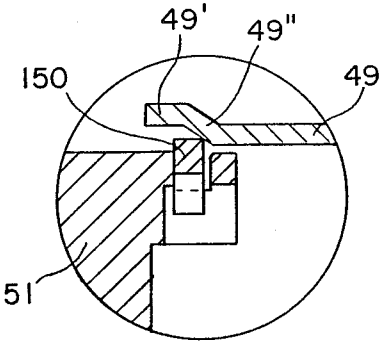
FIG. 8 is a view corresponding to FIG. 4 but showing the relative positions of the synchronizing element and the cup-like element in the operational position, according to FIGS. 6 and 7.

If, as already mentioned, a pressure is exerted on the front end of the hammer bit 7 following contact on the work-piece, then a backward displacement of the tool-spindle 25 begins and with the ensuing displacement of the shifting-element 54, the bush 51, in engagement with this through the annular groove 53, is also displaced backwards, that is, to the right in FIG. 2. As can be seen from FIGS. 6 to 8, by this, the synchronizing element 150 makes contact in the transition region 49'' of the cup-shaped element 49. Because the synchronizing element 150 rotates together with the bush 51, while the cup-shaped element 49, which is connected non-rotatably with the hub 19, is at first stationary, a force is exerted on the synchronizing element 150 in the circumferential direction, so displacing the synchronizing element 150 in the circumferential direction until its bent-in end 152 comes into contact with one end of the reception slot 156 (FIG. 7). The further loading on the synchronizing element 150 then causes its expansion in the radial direction, so that it is not possible for the bush 51 and with it the tool-spindle 25 to move further backwards (to the right in FIG. 2). In addition, because of the engagement of synchronizing element 150 with transition region 49'' of the cup-shaped element 49, a driving force acts on the cup-shaped element 49 and on the hub 19, through which a rotational movement is produced. In this way the hub 19 is slowly accelerated, until it has reached at least approximately the rotational speed of the bush 51.

Figure 13:
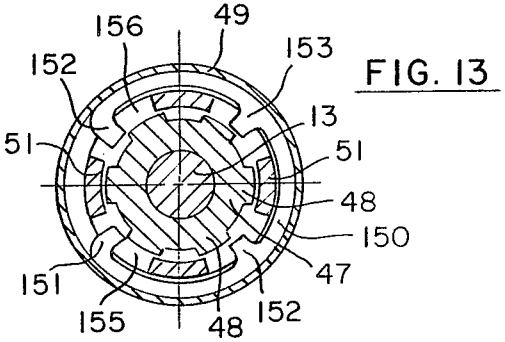
FIG. 13 shows a section through the coupling along line XIII in FIG. 12.
Figure 3:
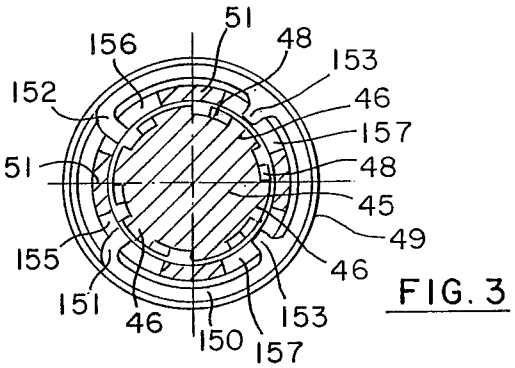
FIG. 3 is a sectional view through the coupling arrangement along line III of FIG. 2.
Figure 14:
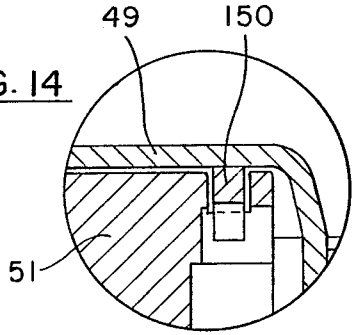
FIG. 14 is a partial view corresponding to FIGS. 4, 8 and 11, showing the relative positions of the synchronizing element and cup-shaped element in the operational conditions according to FIGS. 12 and 13.
Figure 10:
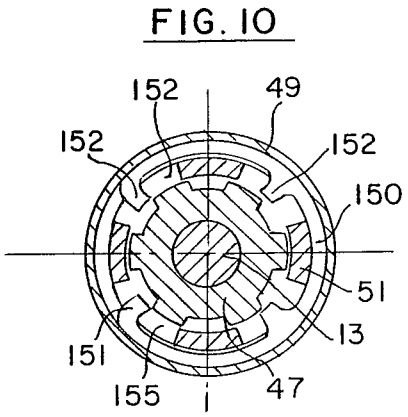
FIG. 10 is a sectional view along line X—X in FIG. 9.
Figure 9:
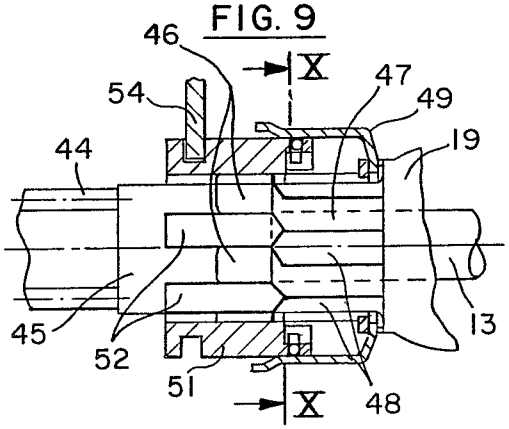
FIG. 9 is a view corresponding to FIG. 6 but showing the beginning of the coupling engagement of the two coupling elements.
Figure 11:
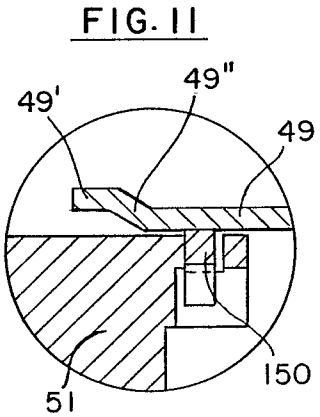
FIG. 11 is a partial view corresponding to FIGS. 4 and 8 and showing the relative positions of the synchronizing element and the cup-shaped element in the operating condition, according to FIGS. 9 and 10.

As soon as there is no longer any significant speed difference between bush 51 together with synchronizing element 150 and cup-shaped element 49, there is also no longer any significant force acting on the synchronizing element 150 in the circumferential direction, to cause a radial enlargement or expansion of the synchronizing element 150. Rather, by this time the synchronizing element 150 is so displaced and compressed that it can enter the cup-shaped element 49 (FIGS. 9 to 11). During this, the right-hand ends of the coupling teeth 52 of the bush 51 approach the left-hand ends of the coupling teeth 48 of the section 47 of the hub 19, and as a result of the effectively equal rotational speeds they can be moved on to each other, so as to enter into engagement with each other. The bevelling provided at the ends of the coupling teeth makes the alignment possible (FIG. 9) so that the bush 51 and the hub 19 turn relative to each other, whereby the coupling teeth 52 of the bush 51 with a corresponding displacement of the tool-spindle 25 and of the shifting-element 54 may slide between the coupling teeth 48 of the section 47 of the hub 19 (FIGS. 12 to 14), against the spring pressure. In this way a positive engagement between the rotating intermediate shaft 13 and the hub 19 is established, and the hammer mechanism is thus activated.

In order to maintain the coupling engagement for operation of the hammer mechanism, the user needs to exert only sufficient force to overcome the forces of the springs acting on the shifting-element 54, while all other forces acting on the coupling during use, in particular through the operation of the hammer mechanism, could in any case cause only small displacements of the hub 19 and the bush 51 relative to each other, without there being a danger of separation of the coupling; that is, the user does not need to exert any pressure to compensate these forces.

The above described embodiments, of course, are not to be construed as limiting the breadth of the present invention. Modifications, and other alternative constructions, will be apparent which are within the spirit and scope of the invention as defined in the appended claims.

What is claimed is:

1. A rotary hammer, comprising:

a rotatable tool-spindle;

a pneumatic hammer mechanism having a ram within said tool-spindle driven by a reciprocating piston;

a rotatably driven intermediate shaft for rotating said tool-spindle and for driving said hammer mechanism;

a coupling for drivingly connecting said intermediate shaft to a driving part of said hammer mechanism, said driving part being rotatably mounted on said intermediate shaft;

said coupling comprising a first coupling element connected to said driving part, and a second coupling element driven by said intermediate shaft and displaceable along the rotational axis of said intermediate shaft into positive coupling engagement with said first coupling element;

a synchronizing arrangement by which, when said coupling elements are brought close together, said first coupling element is accelerated to approximately the rotational speed of said second coupling element;

said synchronizing arrangement having a synchronizing element which first blocks axial approach of said coupling elements and only allows said positive coupling engagement to occur when said first coupling element has been accelerated at least approximately to the rotational speed of said second coupling element; and the synchronizing arrangement having, non-rotatably connected to one of the coupling elements, a cup-shaped element which is open towards the other of the coupling elements and has an open region enlarged in relation to an adjacent wall region, the synchronizing element being connected to the other of the coupling elements and being radially enlargeable through forces acting on it in a circumferential direction, and upon approach of the coupling elements said synchronizing element coming into engagement with the enlarged open region of the cup-shaped element.

2. The rotary hammer of claim 1, wherein said tool-spindle is axially displaceable against a spring force as a result of pressure, in use, on a tool bit in a tool holder of said tool-spindle, and such axial displacement of said tool-spindle causes similar axially displacement of said second coupling element.

3. The rotary hammer of claim 1, wherein the synchronizing element comprises a circular arc-shaped strap of elastically deformable material, opposite ends of which are spaced apart in the circumferential direction, are bent inwardly and project into reception slots extending circumferentially in a holding-section connected non-rotatably with the corresponding coupling element, said strap in the unstressed condition being reciprocatable within limits in the circumferential direction and with loading in the circumferential direction one of its bent-in ends abutting an end of one of the reception slots.

4. The rotary hammer of claim 3, wherein the strap has at least one guide projection between its bent-in ends, said guide projection projecting radially inwardly into a circumferentially extending guide slot in the holding-section.

5. The rotary hammer of claim 3, wherein the holding-section is part of a bush having coupling projections on an inner side, said bush being arranged to be non-rotatable and axially displaceable on said intermediate shaft and forming the second coupling element.

6. The rotary hammer of claim 5, wherein the outer circumference of the bush is provided with an annular groove in which extends a shifting-element coupled with the tool-spindle and axially displaceable therewith.

7. The rotary hammer of claim 6, wherein said shifting-element is displaceable in the direction of the engagement of the coupling elements and is so displaceable against the action of a spring.

8. The rotary hammer of claim 6, comprising a mode change device which can be set to block said shifting-element against movement to prevent axial displacement of said tool-spindle.

9. The rotary hammer of claim 1, wherein said cup-shaped element is made of spring-steel.

10. A rotary hammer, comprising:

a pneumatic hammer mechanism drivable by a driven component rotatably mounted on an axially extending intermediate shaft;

a first coupling element of a coupling non-rotatably connected to said driven component;

a second coupling element of said coupling non-rotatably mounted on said intermediate shaft and axially displaceable into positive coupling engagement with said first coupling element;

synchronizing means for, on approach of said coupling elements towards one another, accelerating said first coupling element at least approximately to the rotational speed of said second coupling element and only then permitting said positive coupling engagement to occur;

said first and second coupling elements having interengageable teeth;

said second coupling element being axially slidable relative to said intermediate shaft; and said synchronizing means comprising an open ended cup-shaped element on one of the coupling elements, and an arcuate strap movably mounted on the other of the coupling elements.

11. The rotary hammer of claim 10, wherein a spring urges said first and second coupling elements apart.

12. The rotary hammer of claim 10, wherein said second coupling element comprises a bush with internally directed teeth, and said strap is located in an annular groove in said bush and is resiliently deformable in said groove.

13. A rotary hammer, comprising:

a rotatable tool-spindle for rotating a tool bit present in use;

a pneumatic mechanism for effecting hammer blows on the tool bit;

means for driving said pneumatic mechanism;

a rotatable intermediate shaft drivingly connected to said tool-spindle for rotation thereof;

coupling means, associated with said shaft, for coupling said shaft to said driving means and disengaging said shaft from said driving means;

said coupling means comprising first and second coupling elements with interengageable teeth;

said second coupling element being mounted on said shaft for rotation therewith;

said first coupling element being rotatably mounted on said shaft;

said first and second coupling elements being relatively displaceable towards and away from each other;

synchronizing means for synchronizing the speeds of rotation of said coupling elements when said coupling elements are relatively displaced towards each other with said shaft rotating;

said synchronizing means including blocking means for blocking engagement of and keeping spaced apart said interengageable teeth until said speeds of rotation are synchronized; and said synchronizing means comprising a flared, open mouthed cup mounted on and surrounding one of said coupling elements, and said blocking means comprising a resiliently deformable arcuate strap located deformably in a groove in the other of said coupling elements.

14. A rotary hammer, comprising:

a pneumatic hammer mechanism drivable by a driven component rotatably mounted on an axially extending intermediate shaft;

a first coupling element of a coupling non-rotatably connected to said driven component;

a second coupling element of said coupling non-rotatably mounted on said intermediate shaft and axially displaceable into positive coupling engagement with said first coupling element; and a synchronizing arrangement operative between said coupling elements to prevent said positive coupling engagement occurring until said coupling elements are rotating at the same speed, said synchronizing arrangement comprising an open ended cup-shaped element on one of the coupling elements and an arcuate strap deformably mounted on the other of the coupling elements.

15. The rotary hammer of claim 14, wherein said second coupling element comprises a bush with internally directed teeth, and said strap is located in an external groove in said bush.

16. The rotary hammer of claim 14, wherein said cup-shaped element surrounds said one of the coupling elements, said strap is resiliently deformable and retractably mounted on said other of the coupling elements, and said strap abuts against said cup upon approach of said coupling elements and blocks positive coupling engagement of said coupling elements until said strap can retract and pass within said cup.

* * * * *